US010023350B2

(12) United States Patent
Faulkner

(10) Patent No.: US 10,023,350 B2
(45) Date of Patent: Jul. 17, 2018

(54) CARTON WITH LOCKING FEATURE

(71) Applicant: Graphic Packaging International, LLC, Atlanta, GA (US)

(72) Inventor: William Faulkner, Marietta, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 15/299,992

(22) Filed: Oct. 21, 2016

(65) Prior Publication Data

US 2017/0113832 A1 Apr. 27, 2017

Related U.S. Application Data

(60) Provisional application No. 62/244,959, filed on Oct. 22, 2015.

(51) Int. Cl.

| | |
|---|---|
| ***B65D 5/10*** | (2006.01) |
| ***B65D 77/30*** | (2006.01) |
| ***B31B 3/60*** | (2006.01) |
| ***B65D 5/06*** | (2006.01) |
| ***B65D 5/54*** | (2006.01) |

(Continued)

(52) U.S. Cl.

CPC ..... *B65D 5/10* (2013.01); *B31B 3/60* (2013.01); *B65D 5/0227* (2013.01); *B65D 5/068* (2013.01); *B65D 5/4266* (2013.01); *B65D 5/541* (2013.01); *B65D 77/30* (2013.01); *B31B 2201/6095* (2013.01); *B31B 2203/066* (2013.01)

(58) Field of Classification Search

CPC ..... B65D 5/10; B65D 5/0227; B65D 5/068; B65D 5/4266; B65D 5/541; B65D 77/30; B65D 5/067; B65D 5/247; B31B 3/60

USPC ..... 229/125.42, 138, 149, 155, 117, 249, 229/188, 213

See application file for complete search history.

(56) References Cited

U.S. PATENT DOCUMENTS

| | | | |
|---|---|---|---|
| 83,812 | A | 11/1868 | Wilcox |
| 362,583 | A | 5/1887 | Jordan |

(Continued)

FOREIGN PATENT DOCUMENTS

| | | | |
|---|---|---|---|
| CN | 203845129 | U | 9/2014 |
| JP | 11-208640 | A | 8/1999 |

(Continued)

OTHER PUBLICATIONS

International Search Report and Written Opinion for PCT/US2016/058120 dated Jan. 24, 2017.

*Primary Examiner* — Christopher Demeree

(74) *Attorney, Agent, or Firm* — Womble Bond Dickinson (US) LLP

(57) ABSTRACT

A carton for holding at least one article. The carton has a front panel and a back panel that at least partially form an interior of the carton. A first end flap is foldably connected to one of the front panel and the back panel and a second end flap is foldably connected to one of the front panel and the back panel. Locking features are for releasably securing the end flaps in a closed configuration with the first end flap and the second end flap in face-to-face contact. The locking features comprise a male locking feature foldably connected to at least one of the first end flap and the second end flap, and a female locking feature adjacent at least one of the first end flap and the second end flap.

30 Claims, 4 Drawing Sheets

(51) Int. Cl.
*B65D 5/42* (2006.01)
*B65D 5/02* (2006.01)

(56) References Cited

U.S. PATENT DOCUMENTS

| | | | | | |
|---|---|---|---|---|---|
| 567,649 | A | * | 9/1896 | Lanzit | B65D 5/46096 229/117.14 |
| 1,082,868 | A | | 12/1913 | Hollett | |
| 2,757,851 | A | | 8/1956 | Moore | |
| 3,300,115 | A | | 1/1967 | Schauer | |
| 3,640,380 | A | * | 2/1972 | Huffman | A47J 47/14 206/194 |
| D242,901 | S | * | 1/1977 | Lohrbach | D9/432 |
| 4,238,069 | A | * | 12/1980 | Morris, Jr. | B65D 5/2047 229/114 |
| 4,252,267 | A | | 2/1981 | Osborne | |
| 4,313,553 | A | | 2/1982 | Lisiecki | |
| 4,530,459 | A | * | 7/1985 | Maroszek | B65D 5/46096 229/117.12 |
| 4,762,234 | A | | 8/1988 | Wyberg | |
| 5,255,494 | A | | 10/1993 | Doyle | |
| 5,501,394 | A | | 3/1996 | Eno | |
| 5,816,487 | A | | 10/1998 | Skinner | |
| 5,988,494 | A | | 11/1999 | Fontaine | |
| 5,996,882 | A | | 12/1999 | Randall | |
| 6,164,821 | A | | 12/2000 | Randall | |
| 6,929,172 | B2 | | 8/2005 | Bates et al. | |
| 7,331,509 | B2 | | 2/2008 | Bates et al. | |
| 7,617,969 | B2 | | 11/2009 | Oliveira | |
| 8,770,469 | B2 | | 7/2014 | Burke et al. | |
| 2003/0111521 | A1 | | 6/2003 | Holmes | |
| 2004/0102748 | A1 | | 5/2004 | Hirotsu | |
| 2004/0112948 | A1 | | 6/2004 | Bone | |
| 2005/0209576 | A1 | | 9/2005 | Hirotsu | |
| 2007/0194093 | A1 | | 8/2007 | Ford | |

FOREIGN PATENT DOCUMENTS

| | | | |
|---|---|---|---|
| JP | 2005-154001 | A | 6/2005 |
| KR | 20-1998-0019535 | | 7/1998 |
| KR | 10-0211329 | | 8/1999 |
| KR | 10-0354924 | | 10/2002 |
| KR | 10-2004-0004669 | | 1/2004 |
| KR | 10-2005-0013599 | | 2/2005 |
| KR | 20-0449014 | Y1 | 6/2010 |

* cited by examiner

CARTON WITH LOCKING FEATURE

CROSS-REFERENCE TO RELATED APPLICATION

This application claims the benefit of U.S. Provisional Patent Application No. 62/244,959, filed on Oct. 22, 2015.

INCORPORATION BY REFERENCE

The disclosure of U.S. Provisional Patent Application No. 62/244,959, filed Oct. 22, 2015, is hereby incorporated by reference for all purposes as if presented herein in its entirety.

BACKGROUND OF THE DISCLOSURE

The present disclosure relates to packages or cartons, blanks for forming cartons, and methods associated with cartons and blanks for holding and carrying articles.

SUMMARY OF THE DISCLOSURE

In general, one aspect of the disclosure is generally directed to a carton for holding an article or a plurality of articles. The carton comprises a gable top comprising two top flaps at a top of the carton foldably connected to a respective front and back panel of the carton. The carton comprises a locking flap foldably connected to at least one of the two top flaps for locking the carton in the closed configuration.

In another aspect, the disclosure is generally directed to a carton for containing at least one article. The carton comprises panels that extend at least partially around the interior of the carton. The panels comprise a front panel, a first side panel, a second side panel, and a back panel. A first top flap is foldably connected to the front panel and a second top flap is foldably connected to the back panel. The carton comprises a first top gusset foldably connected to the first side panel and the back panel, and a second top gusset foldably connected to the second side panel and the front panel. Locking features include a locking flap foldably connected to the second top flap and a locking opening in at least one of the front panel and the first top flap.

In another aspect, the disclosure is generally directed to a blank for forming a carton for holding at least one article.

In another aspect, the disclosure is generally directed to a method of forming a carton for containing at least one article.

In another aspect, the disclosure is generally directed to a carton for holding at least one article. The carton comprises a plurality of panels that extends at least partially around an interior of the carton. The plurality of panels comprises a front panel, a first side panel foldably connected to the front panel, a back panel foldably connected to the first side panel, and a second side panel foldably connected to the back panel. At least two end flaps are respectively foldably connected to a respective panel of the plurality of panels. The at least two end flaps are for closing an end of the carton. The at least two end flaps comprise a first end flap foldably connected to one of the front panel and the back panel, and a second end flap foldably connected to one of the front panel and the back panel. Locking features are for releasably securing the at least two end flaps in a closed configuration of the carton with the first end flap and the second end flap in face-to-face contact. The locking features comprise a male locking feature foldably connected to at least one of the first end flap and the second end flap and a female locking feature adjacent at least one of the first end flap and the second end flap.

In another aspect, the disclosure is generally directed to a blank for forming a carton for holding at least one article. The blank comprises a plurality of panels comprising a front panel, a first side panel foldably connected to the front panel, a back panel foldably connected to the first side panel, and a second side panel foldably connected to the back panel. At least two end flaps are respectively foldably connected to a respective panel of the plurality of panels. The at least two end flaps are for closing an end of the carton formed from the blank. The at least two end flaps comprising a first end flap foldably connected to one of the front panel and the back panel, and a second end flap foldably connected to one of the front panel and the back panel. Locking features are for releasably securing the at least two end flaps in a closed configuration of the carton formed from the blank with the first end flap and the second end flap in face-to-face contact. The locking features comprise a male locking feature foldably connected to at least one of the first end flap and the second end flap, and a female locking feature adjacent at least one of the first end flap and the second end flap.

In another aspect, the disclosure is generally directed to a method of forming a carton for holding at least one article. The method comprises obtaining a blank having a plurality of panels comprising a front panel, a first side panel foldably connected to the front panel, a back panel foldably connected to the first side panel, and a second side panel foldably connected to the back panel. At least two end flaps are respectively foldably connected to a respective panel of the plurality of panels. The at least two end flaps comprise a first end flap foldably connected to one of the front panel and the back panel, and a second end flap foldably connected to one of the front panel and the back panel. The blank has locking features comprising a male locking feature foldably connected to at least one of the first end flap and the second end flap and a female locking feature adjacent at least one of the first end flap and the second end flap. The method comprises positioning the plurality of panels to extend at least partially around an interior of the carton, positioning the at least two end flaps to close an end of the carton by forming a closed configuration of the carton with the first end flap in face-to-face contact with the second end flap, and activating the locking features to releasably secure the at least two end flaps in the closed configuration by inserting the male locking feature into the female locking feature.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

Cartons or packages according to the present disclosure can accommodate articles of numerous different shapes. For the purpose of illustration and not for the purpose of limiting the scope of the disclosure, the following detailed description describes articles such as food products at least partially disposed within the carton embodiments. In this specification, the terms "lower," "bottom," "upper", "top", "front", and "back" indicate orientations determined in relation to fully erected cartons.

Figure 1:
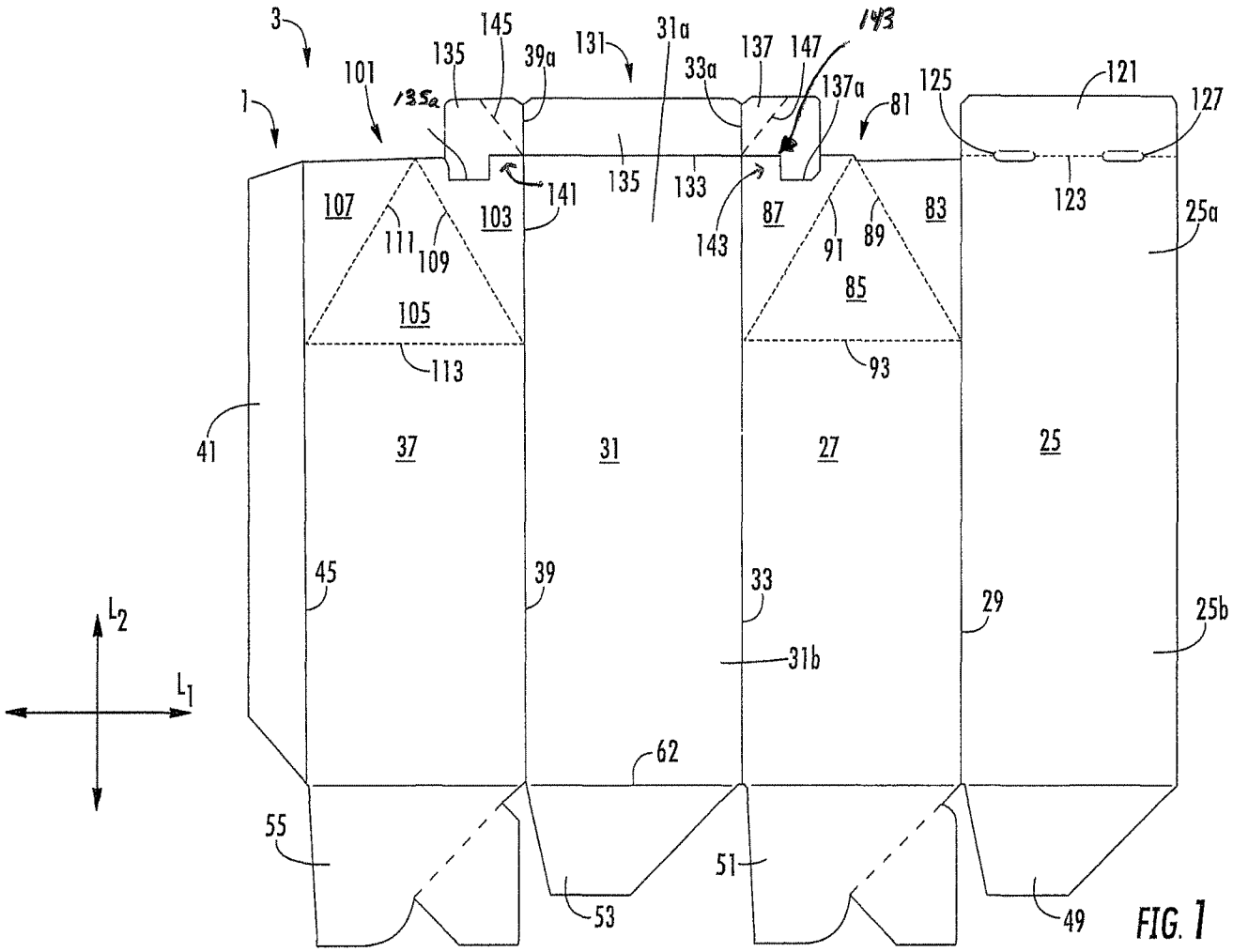
FIG. 1 is a plan view of an exterior surface of a blank for forming a carton according to an exemplary embodiment of the present disclosure.
Figure 3A:
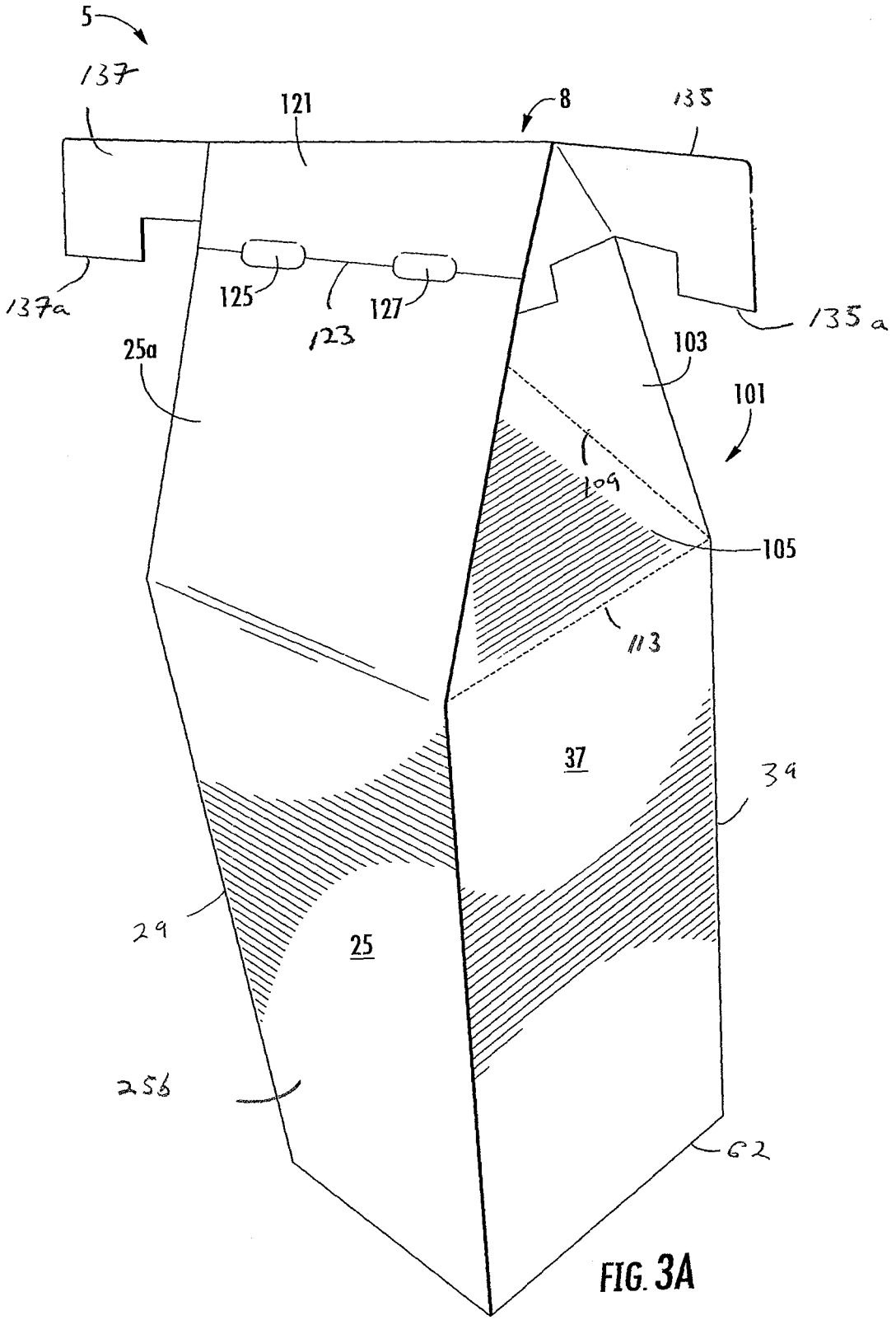
FIG. 3A is a perspective view of a carton formed from the blank of FIG. 1A having locking tabs shown in an unlocked condition.
Figure 3B:
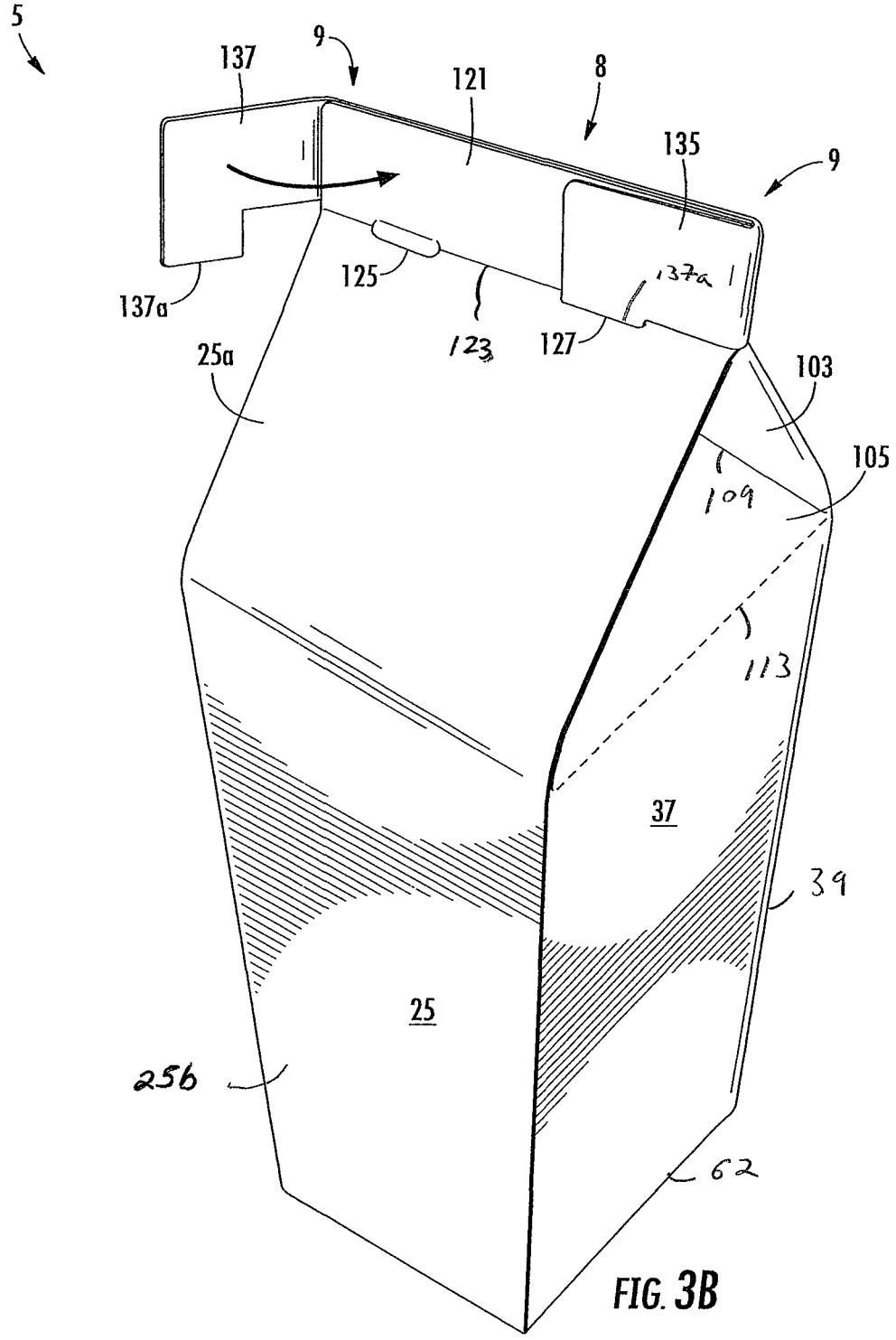
FIG. 3B is a perspective view of a carton formed from the blank of FIG. 1A having locking tabs shown in a locked position.

FIG. 1 is a plan view of an exterior surface 1 of a carton blank 3 used to form a carton 5 (FIGS. 3A, 3B) of one embodiment of the disclosure. The carton 5 can be used to hold one article or a plurality of articles (not shown) such as food products (e.g., candy, energy bar, granola bar, dairy bar, or any other food product), beverage products, or other liquid or dry product such as laundry detergent or cosmetics, or any other article or product. As shown in FIGS. 3A and 3B, the carton 5 has a gable top 8 with two locking features 9 for locking the top of the carton to prevent access to the carton and unlocking the top of the carton to allow access to the carton. The carton 5 can include various dispensing features and various handle features without departing from the disclosure.

The blank 3 has a longitudinal axis L1 and a lateral axis L2. The blank 3 includes a front panel 25 foldably connected to a first side panel 27 at a lateral fold line 29. A back panel 31 is foldably connected to the first side panel 27 at a lateral fold line 33. A second side panel 37 is foldably connected to the back panel 31 at a lateral fold line 39. An adhesive flap 41 is foldably connected to the second side panel 37 at a lateral fold line 45.

As shown in FIG. 1, bottom end flaps 49, 51, 53, 55 are respectively foldably connected to a respective one of the front panel 25, first side panel 27, back panel 31, and second side panel 37. The bottom end flaps 49, 51, 53, 55 are foldably connected to respective panels 25, 27, 31, 37 at a marginal portion of the blank 3 by a longitudinal fold line 62. The fold line 62 can be otherwise shaped or be offset at portions of the blank 3 without departing from the disclosure. Further, the bottom end flaps 49, 51, 53, 55 have features for facilitating overlapping and locking the end flaps to form a closed bottom of the carton 5. The end flaps 49, 51, 53, 55 could be otherwise shaped, arranged, and/or configured without departing from the disclosure.

In the illustrated embodiment, the blank 3 has a first gusset 81 foldably connected to the front panel 25, the back panel 31, and the first side panel 27. The first gusset 81 comprises a first gusset panel 83 foldably connected to the front panel 25 along fold line 29, a second gusset panel 87 foldably connected to back panel 31 along fold line 33, and a third, central gusset panel 85 foldably connected to the first and second gusset panels 83, 87 along respective oblique fold lines 89, 91 and foldably connected to the first side panel 27 along a lateral fold line 93. Each of the first, second, and third gusset panels 83, 87, and 85 are generally triangular in configuration. The gusset panels 83, 85, 87 could be otherwise shaped, arranged, configured, and/or oriented without departing from the disclosure.

In one embodiment, the blank 3 includes a second gusset 101 foldably connected to the back panel 31, the adhesive flap 41 and the second side panel 37 and having similar features as the first gusset 81. In particular, the second gusset 101 comprises a fourth gusset panel 103 foldably connected to the back panel 31 along fold line 39, a fifth gusset panel 107 foldably connected to adhesive flap 41 along fold line 45, and a sixth, central gusset panel 105 foldably connected to the fourth and fifth gusset panels 103, 107 along respective oblique fold lines 109, 111 and foldably connected to the second side panel 37 along a lateral fold line 113. Each of the fourth, fifth, and sixth gusset panels 103, 107, 105 are generally triangular in configuration. The gusset panels 103, 105, 107 could be otherwise shaped, arranged, configured, and/or oriented without departing from the disclosure. The gussets 81, 101 cooperate with the front and back panels 25, 31 to form the gable top 8 of the carton 5 (FIGS. 3A, 3B). The gussets 81, 101 could be otherwise shaped, arranged, and/or configured without departing from the disclosure.

In one embodiment, the blank 3 includes a first top end flap 121 foldably connected to the front panel 25 at a lateral fold line 123. In the illustrated embodiment, the blank 3 includes two openings 125, 127 aligned with the lateral fold line 123. In embodiments, one or both of openings 125, 127 may intersect lateral fold line 123. In embodiments, a portion of one or both of openings 125, 127 may extend into front panel 25. In one embodiment, the openings 125, 127 include elliptical-shaped openings that are collinear with the fold line 123, but the openings 125, 127 could be other forms such as cuts, slits, tear lines, etc., or other shapes (e.g., circular, rectangular, etc.), or any suitable opening or line of weakening without departing from the disclosure.

As shown in FIG. 1, the blank 3 includes a second top end flap 131 foldably connected to the back panel 31 at a lateral fold line 133. In one embodiment, the blank 3 includes a first locking tab 135 foldably connected to the second top end flap 131 at a portion 39*a* of the longitudinal fold line 39, and a second locking tab 137 foldably connected to the second top end flap 131 at a portion 33*a* of the longitudinal fold line 33. In one embodiment, the first locking tab 135 is defined by a tear line 141 in the fourth gusset panel 103 and the second locking tab 137 is defined by a tear line 143 in the second gusset panel 87 such that the locking tabs 135, 137 are respectively separable from the fourth gusset panel 103 and the second gusset panel 87. Each locking tab 135, 137 includes an oblique fold line 145, 147 extending from a respective portion 33*a*, 39*a* of the fold line 33, 39. The locking tabs 135, 137 could be otherwise shaped, arranged, and/or configured without departing from the disclosure.

Figure 2:
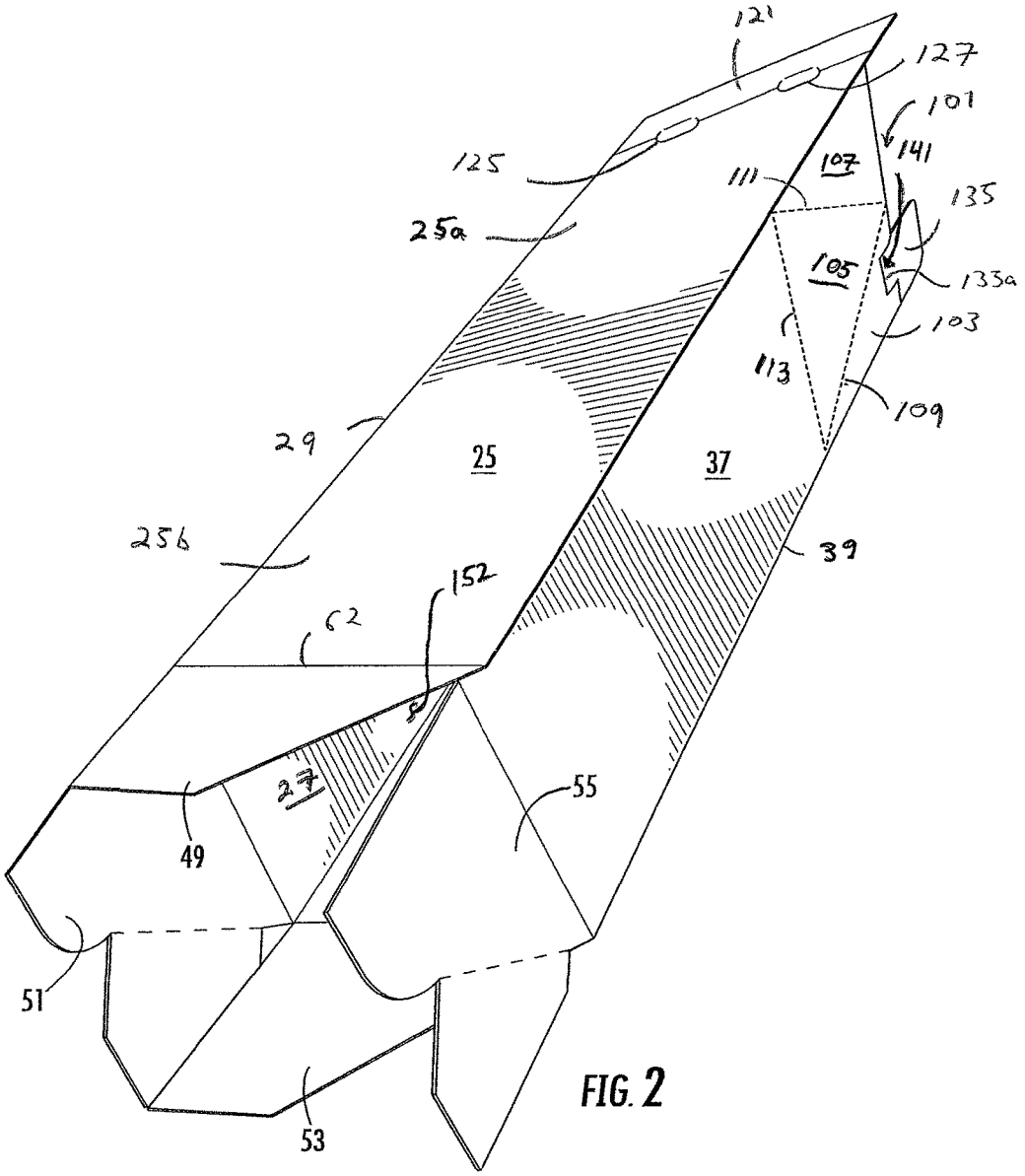
FIG. 2 is a partially-assembled view of the blank of FIG. 1A.

Referring additionally to FIG. 2, in accordance with one acceptable example, the carton 5 (FIGS. 3A, 3B) is formed from the blank 3, by folding the panels 25, 27, 31, 37 along fold lines 29, 33, 39 and adhesively attaching the adhesive flap 41, that is folded about fold line 45, to front panel 25 to at least partially extend around an interior 152 of the carton 5. The bottom of the carton 5 can be closed by overlapping the bottom end flaps 49, 51, 53, 55, one or more of which can be positioned into face-to-face contact. One or more of the bottom end flaps 49, 51, 53, 55 can be adhesively secured such as by glue without departing from the disclosure. The carton 5 can be filled with an article or a plurality of articles after closing the bottom or prior to closing the bottom without departing from the disclosure.

The blank 3 can by formed into the carton 5 and loaded with articles by a suitable packaging system (not shown). In this regard, the packaging system can comprise different stations, modules, or components, such as a carton forming station, a wrapping station, a pick and place station, a closing or sealing station, or any other suitable station or components. The blank 3 can be formed into the carton 5 by other packaging systems without departing from the disclosure.

Still referring to FIG. 1, and referring additionally to FIG. 3A, the gable top 8 of the carton 5 can be closed by activating the gussets 81, 101 to position the third and sixth central gusset panel 85, 105 of each gusset 81, 101 inwardly relative to a respective side panel 27, 37, positioning the second and fourth gusset panels 87, 103 to be in face-to-face contact or adjacent with the back panel 31, and positioning the first and fifth gusset panels 83, 107 to be in face-to-face contact or adjacent with the front panel 25. When the gussets 81, 101 are activated to form the gable top 8 of the carton 5, the upper portions 25*a*, 31*a* of the front panel 25 and the back panel 31 are positioned obliquely relative to the bottom portions 25*b*, 31*b* of the front and back panel so that the upper portions 25*a*, 31*a* converge, and the first top end flap 121 and the second top end flap 131 are brought into face-to-face contact to close the top of the carton.

With reference to FIGS. 1, 3A, and 3B, one or both of the two locking features 9 are activated to lock the top 8 of the carton 5 and releasably secure the top end flaps 121, 131 in face-to-face contact in the closed configuration by folding the first locking tab 135 to overlap the first top end flap 121 and inserting the locking tab 135 into the locking opening 125 in the front panel. The second locking tab 137 is folded to overlap the first top end flap 121 and inserted into the locking opening 127 to lock the carton 5 in the closed configuration. In one embodiment, each locking tab 135, 137 has a locking portion 135*a*, 137*a* shaped for insertion into a respective locking opening 125, 127. The top 8 of the carton 5 can have locking features 9 that are otherwise shaped, arranged, configured, and/or positioned without departing from the disclosure. In this regard, locking tabs 135, 137 form male locking features and locking openings 125, 127 form female locking features for the carton 5.

In one embodiment, the interior 152 of the carton 5 can be accessed by removing the locking tabs 135, 137 from a respective locking opening 125, 127 so that the top of the carton 5 can be positioned in an open configuration allowing access to articles held in the carton. The carton 5 can be reclosed by reinserting the locking tabs 135, 137 into a respective locking opening 125, 127.

The carton 5 could include various handle features for carrying the carton and could include various dispenser features for opening the carton. Further, the carton 5 could include other panel/flap closing configurations without departing from the disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding at least one article, comprising:

a plurality of panels that extends at least partially around an interior of the carton, the plurality of panels comprising a front panel, a first side panel foldably connected to the front panel, a back panel foldably connected to the first side panel, and a second side panel foldably connected to the back panel;

at least two end flaps respectively foldably connected to respective panels of the plurality of panels, the at least two end flaps closing an end of the carton, the at least two end flaps comprising a first end flap foldably connected to one of the front panel and the back panel, and a second end flap foldably connected to the other of the front panel and the back panel; and locking features comprising male locking features and female locking features for releasably securing the at least two end flaps in a closed configuration of the carton with the first end flap and the second end flap in face-to-face contact, the male locking features comprise a first locking tab and a second locking tab each foldably connected to the second end flap and each of the first locking tab and the second locking tab folded into face-to-face contact with the second end flap, the female locking features comprise a first locking opening and a second locking opening each adjacent the first end flap.

2. The carton of claim 1, wherein the first end flap is foldably connected to the front panel at a fold line and at least one of the first locking opening and the second locking opening intersects the fold line.

3. The carton of claim 2, wherein the at least one of the first locking opening and the second locking opening extends into a portion of the first end flap and a portion of the front panel.

4. The carton of claim 1, wherein each of the first locking tab and the second locking tab has a locking portion inserted into a respective locking opening.

5. The carton of claim 1, further comprising a first gusset foldably connected to each of the first side panel, the front panel, and the back panel, and a second gusset foldably connected to each of the second side panel, the front panel, and the back panel.

6. The carton of claim 5, wherein the first gusset comprises a first gusset panel foldably connected to the front panel, a second gusset panel foldably connected to the back panel, and a third gusset panel foldably connected to each of the first side panel, the first gusset panel, and the second gusset panel.

7. The carton of claim 6, wherein the second gusset comprises a fourth gusset panel foldably connected to the back panel, a fifth gusset panel foldably connected to the front panel, and a sixth gusset panel foldably connected to each of the second side panel, the fourth gusset panel, and the fifth gusset panel.

8. The carton of claim 7, wherein the carton comprises a gable top including the first gusset, the second gusset, an upper portion of the front panel, and an upper portion of the back panel, the upper portion of the front panel is folded relative to a lower portion of the front panel, and the upper portion of the back panel is folded relative to a lower portion of the back panel so that the upper portion of the front panel and the upper portion of the back panel converge.

9. The carton of claim 8, wherein the gable top comprises the first gusset panel and the fifth gusset panel in face-to-face contact with the upper portion of the front panel, and the second gusset panel and fourth gusset panel in face-to-face contact with the upper portion of the back panel.

10. The carton of claim 8, wherein the first locking tab is separable from the fourth gusset panel at a first tear line, and the second locking tab is separable from the second gusset panel at a second tear line.

11. The carton of claim 1, wherein the at least one of the first end flap and the second end flap has a width that is equal to a width of the respective one of the front panel and the back panel.

12. The carton of claim 1, wherein the first end flap is foldably connected to the front panel and the second end flap is foldably connected to the back panel at a longitudinal fold line, the second end flap comprises a top edge, a bottom edge proximate the longitudinal fold line, a first side edge extending from the top edge to the bottom edge, and a second side edge opposite the first side edge and extending from the top edge to the bottom edge, the first locking tab is foldably connected to the first side edge of the second end flap and the second locking tab is foldably connected to the second side edge of the second end flap.

13. A blank for forming a carton for holding at least one article, the blank comprising:

a plurality of panels comprising a front panel, a first side panel foldably connected to the front panel, a back panel foldably connected to the first side panel, and a second side panel foldably connected to the back panel;

at least two end flaps respectively foldably connected to respective panels of the plurality of panels, the at least two end flaps are for closing an end of the carton formed from the blank, the at least two end flaps comprising a first end flap foldably connected to the front panel, and a second end flap foldably connected to the back panel at a longitudinal fold line, the second end flap comprises a top edge, a bottom edge proximate the longitudinal fold line, a first side edge extending from the top edge to the bottom edge, and a second side edge opposite the first side edge and extending from the top edge to the bottom edge; and locking features comprising male locking features and female locking features for releasably securing the at least two end flaps in a closed configuration of the carton formed from the blank with the first end flap and the second end flap in face-to-face contact, the male locking features comprise a first locking tab foldably connected to the first side edge of the second end flap and a second locking tab foldably connected to the second side edge of the second end flap, the female locking features comprise a first locking opening and a second locking opening each adjacent of the first end flap.

14. The blank of claim 13, wherein when the blank is in the closed configuration of the carton with the first end flap in face-to-face contact with the second end flap, each of the first locking tab and the second locking tab is folded relative to the second end flap to be in face-to-face contact with the first end flap.

15. The blank of claim 14, wherein the longitudinal fold line is a first longitudinal fold line, and the first end flap is foldably connected to the front panel at a second longitudinal fold line and at least one of the first locking opening and the second locking opening intersects the second longitudinal fold line.

16. The blank of claim 15, wherein the at least one of the first locking opening and the second locking opening extends into a portion of the first end flap and a portion of the front panel.

17. The blank of claim 13, further comprising a first gusset foldably connected to each of the first side panel, the front panel, and the back panel, and a second gusset foldably connected to each of the second side panel, the front panel, and the back panel.

18. The blank of claim 17, wherein the first gusset comprises a first gusset panel foldably connected to the front panel, a second gusset panel foldably connected to the back panel, and a third gusset panel foldably connected to each of the first side panel, the first gusset panel, and the second gusset panel.

19. The blank of claim 18, wherein the second gusset comprises a fourth gusset panel foldably connected to the back panel, a fifth gusset panel foldably connected to the front panel, and a sixth gusset panel foldably connected to each of the second side panel, the fourth gusset panel, and the fifth gusset panel.

20. The blank of claim 19, wherein the first locking tab is separable from the fourth gusset panel at a first tear line, and the second locking tab is separable from the second gusset panel at a second tear line.

21. The blank of claim 13, wherein the at least one of the first end flap and the second end flap has a width that is equal to a width of the respective one of the front panel and the back panel.

22. A method of forming a carton for holding at least one article, the method comprising:

obtaining a blank having a plurality of panels comprising a front panel, a first side panel foldably connected to the front panel, a back panel foldably connected to the first side panel, and a second side panel foldably connected to the back panel, at least two end flaps respectively foldably connected to respective panels of the plurality of panels, the at least two end flaps comprising a first end flap foldably connected to one of the front panel and the back panel, and a second end flap foldably connected to the other of the front panel and the back panel, and locking features comprising male locking features and female locking features, the male locking features comprise a first locking tab and a second locking tab each foldably connected to the second end flap, the female locking features comprise a first locking opening and a second locking opening each adjacent the first end flap, positioning the plurality of panels to extend at least partially around an interior of the carton, positioning the at least two end flaps to close an end of the carton by forming a closed configuration of the carton with the first end flap in face-to-face contact with the second end flap, and activating the locking features to releasably secure the at least two end flaps in the closed configuration by folding each of the first locking tab and the second locking tab relative to the second end flap and into face-to-face contact with the first end flap and inserting the first locking tab into the first locking opening and inserting the second locking tab into the second locking opening.

23. The method of claim 22, wherein the first end flap is foldably connected to the front panel, and the second end flap is foldably connected to the back panel.

24. The method of claim 22, wherein each of the first locking tab and the second locking tab has a locking portion and the activating the locking features comprises inserting the respective locking portion into the respective locking opening.

25. The method of claim 22, wherein the blank comprises a first gusset foldably connected to each of the first side panel, the front panel, and the back panel, and a second gusset foldably connected to each of the second side panel, the front panel, and the back panel.

26. The method of claim 25, wherein the first gusset comprises a first gusset panel foldably connected to the front panel, a second gusset panel foldably connected to the back panel, and a third gusset panel foldably connected to each of the first side panel, the first gusset panel, and the second gusset panel, the second gusset comprises a fourth gusset panel foldably connected to the back panel, a fifth gusset panel foldably connected to the front panel, and a sixth gusset panel foldably connected to each of the second side panel, the fourth gusset panel, and the fifth gusset panel.

27. The method of claim 26, wherein the forming the closed configuration of the carton comprises forming a gable top including the first gusset, the second gusset, an upper portion of the front panel, and an upper portion of the back panel, the forming the gable top comprises folding the upper portion of the front panel relative to a lower portion of the front panel and folding the upper portion of the back panel relative to a lower portion of the back panel so that the upper portion of the front panel and the upper portion of the back panel converge.

28. The method of claim 27, wherein the forming the gable top comprises positioning the first gusset panel and the fifth gusset panel in face-to-face contact with the upper portion of the front panel and positioning the second gusset panel and the fourth gusset panel in face-to-face contact with the upper portion of the back panel.

29. The method of claim 22, wherein the at least one of the first end flap and the second end flap has a width that is equal to a width of the respective one of the front panel and the back panel.

30. The method of claim 22, wherein the first end flap is foldably connected to the front panel and the second end flap is foldably connected to the back panel at a longitudinal fold line, the second end flap comprises a top edge, a bottom edge proximate the longitudinal fold line, a first side edge extending from the top edge to the bottom edge, and a second side edge opposite the first side edge and extending from the top edge to the bottom edge, the first locking tab is foldably connected to the first side edge of the second end flap and the second locking tab is foldably connected to the second side edge of the second end flap.

* * * * *